US011420455B2

(12) United States Patent
Kimata

(10) Patent No.: US 11,420,455 B2
(45) Date of Patent: Aug. 23, 2022

(54) CONVEYING DEVICE AND IMAGE FORMING APPARATUS INCLUDING CONVEYING DEVICE

(71) Applicant: Ricoh Company, Ltd., Tokyo (JP)

(72) Inventor: Masanobu Kimata, Gifu (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/213,459

(22) Filed: Mar. 26, 2021

(65) Prior Publication Data

US 2021/0309023 A1 Oct. 7, 2021

(30) Foreign Application Priority Data

Apr. 1, 2020 (JP) ..... JP2020-065855

(51) Int. Cl.
*B41J 13/00* (2006.01)
*B41J 11/00* (2006.01)

(52) U.S. Cl.
CPC ..... *B41J 13/0036* (2013.01); *B41J 11/0095* (2013.01)

(58) Field of Classification Search
CPC ..... B41J 13/0036; B41J 11/0095
See application file for complete search history.

(56) References Cited

U.S. PATENT DOCUMENTS

2007/0176357 A1 8/2007 Horio et al.
2009/0129840 A1 5/2009 Takekawa et al.
2010/0252981 A1 10/2010 Kimata et al.
2011/0190109 A1 8/2011 Kimata
2011/0221125 A1 9/2011 Kimata
2013/0270761 A1 10/2013 Kimata
2016/0355364 A1 12/2016 Shibata et al.
2020/0231399 A1 7/2020 Shibata et al.

FOREIGN PATENT DOCUMENTS

JP 2018-193168 12/2018
JP 2019-172457 10/2019
WO WO-2008108190 A1 * 9/2008 ..... B41J 11/0015

* cited by examiner

*Primary Examiner* — Justin Seo
(74) *Attorney, Agent, or Firm* — Xsensus LLP

(57) ABSTRACT

A conveying device includes a plurality of conveyance passages, a plurality of conveyors, a conveyance passage guide, a conveyance sensor, a conveyance availability detector, and circuitry. The conveyance passages are disposed in parallel to each other. Each conveyors is disposed in corresponding one of the conveyance passages. The circuitry is configured to: set a set retention time for which a conveyance object is to be retained in available one of the conveyance passages; control one of the conveyors to convey and stop conveying the conveyance object guided by the conveyance passage guide; measure a retention time of the conveyance object conveyed in the available one of the conveyance passages; and cause the one of the conveyors to eject the conveyance object from the available one of the conveyance passages in a case in which the retention time of the conveyance object is longer than the set retention time.

10 Claims, 8 Drawing Sheets

CONVEYING DEVICE AND IMAGE FORMING APPARATUS INCLUDING CONVEYING DEVICE

CROSS-REFERENCE TO RELATED APPLICATION

This patent application is based on and claims priority pursuant to 35 U.S.C. § 119(a) to Japanese Patent Application No. 2020-065855, filed on Apr. 1, 2020, in the Japan Patent Office, the entire disclosure of which is hereby incorporated by reference herein.

BACKGROUND

Technical Field

Embodiments of the present disclosure relate to a conveying device, an image forming apparatus, and an image forming system.

Related Art

There is known an image forming apparatus including an image forming apparatus that discharges liquid onto a sheet-shaped medium to form an image, a conveying device that conveys the medium on which the image is formed, and a mechanism that performs predetermined post-processing on the conveyed medium.

In recent years, particularly in image forming apparatuses used in the commercial printing field, there has been an increasing demand for speeding up the image formation process and improving the productivity including post-processing on sheets. When post-processing is performed on a medium on which an image formation process using liquid ink has been performed, it is necessary to dry the liquid ink adhering to the medium. In general, the drying time tends to be longer than the image forming time. In view of this, a technology is known in which a plurality of conveyance passages are provided between an image forming apparatus and a post-processing apparatus, and a function of drying is provided in each conveyance passage.

SUMMARY

According to an aspect of the present disclosure, there is provided a conveying device that includes a plurality of conveyance passages, a plurality of conveyors, a conveyance passage guide, a conveyance sensor, a conveyance availability detector, and circuitry. The plurality of conveyance passages are disposed in parallel to each other. Each one of the plurality of conveyors is disposed in corresponding one of the plurality of conveyance passages. The conveyance passage guide is configured to guide a conveyance object to available one of the plurality of conveyance passages. The conveyance sensor is configured to detect the conveyance object conveyed by the conveyance passage guide. The conveyance availability detector is configured to detect whether the plurality of conveyance passages are available for conveyance of the conveyance object. The circuitry is configured to: set a set retention time for which the conveyance object is to be retained in the available one of the plurality of conveyance passages; control one of the plurality of conveyors to convey and stop conveying the conveyance object guided by the conveyance passage guide; measure a retention time of the conveyance object conveyed in the available one of the plurality of conveyance passages; and cause the one of the plurality of conveyors to eject the conveyance object from the available one of the plurality of conveyance passages in a case in which the retention time of the conveyance object is longer than the set retention time.

According to another aspect of the present disclosure, there is provided an image forming apparatus that includes a plurality of conveyance passages, a plurality of conveyors, an image forming device, a conveyance passage guide, a conveyance availability detector, and circuitry. The plurality of conveyance passages are disposed in parallel to each other. Each one of the plurality of conveyors is disposed in corresponding one of the plurality of conveyance passages. The image forming device is configured to form images on one set of a plurality of conveyance objects. The conveyance passage guide is configured to guide each one of the plurality of conveyance objects to available one of the plurality of conveyance passages. The conveyance availability detector is configured to detect whether the plurality of conveyance passages are available for conveyance of the plurality of conveyance objects. The circuitry is configured to: set a set retention time for which each one of the plurality of conveyance objects is to be retained in the available one of the plurality of conveyance passages, according to content of an image forming process performed on each one of the plurality of conveyance objects; control one of the plurality of conveyors to convey and stop conveying each one of the plurality of conveyance objects guided by the conveyance passage guide; measure a retention time of each one of the plurality of conveyance objects conveyed in the available one of the plurality of conveyance passages; change an order of image forming processes performed on the one set of the plurality of conveyance objects, according to the set retention time for each one of the plurality of conveyance objects; cause the image forming device to perform the image forming processes on the plurality of conveyance objects in the order changed; cause the plurality of conveyance objects to be conveyed to the plurality of conveyance passages; and cause the plurality of conveyors to eject the plurality of conveyance objects from the plurality of conveyance passages according to a pre-change order of the image forming processes.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
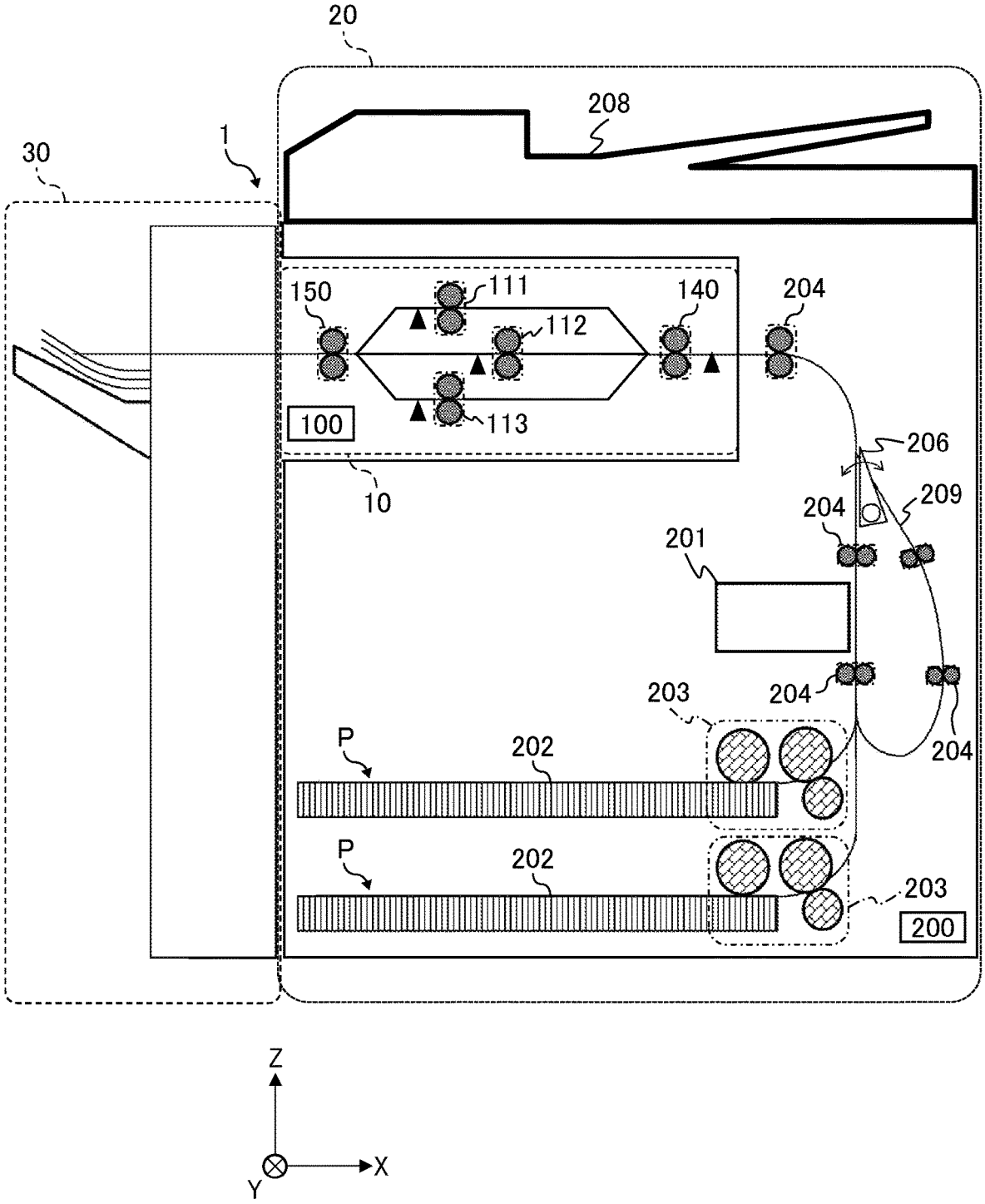
FIG. 1 is a schematic diagram of an inkjet printer as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of the present disclosure are described with reference to the drawings.

Referring now to the drawings, wherein like reference numerals designate identical or corresponding parts throughout the several views, exemplary embodiments of the present disclosure are described below.

Hereinafter, a conveying device and an image forming apparatus according to embodiments of the present disclosure are described with reference to drawings. As a conveying device according to an embodiment of the present disclosure, for example, there is provided a device that has a function of distributing and conveying a sheet-shaped medium ejected from an image forming apparatus to a plurality of conveyance passages (conveyance paths) arranged in parallel and drying the medium in the conveyance passages. As an image forming apparatus according to an embodiment of the present disclosure, for example, there is provided an inkjet printer including an image forming device that forms an image on a sheet-shaped medium using liquid ink which is a liquid material and a conveying device that conveys the medium on which the image is formed by the image forming device.

Embodiment of Image Forming Apparatus

FIG. 1 is a diagram illustrating an overall configuration of an inkjet printer 1 that is an image forming apparatus according to an embodiment of the present disclosure. The inkjet printer 1 includes an image forming apparatus 20 as an image forming apparatus, and a relay conveying device 10 as a conveying device to convey a sheet P as a sheet-shaped medium conveyed from the image forming apparatus 20 using a predetermined conveyance passage and deliver the sheet P to a post-processing apparatus 30. The post-processing apparatus 30 as a post-processing apparatus is an apparatus that performs predetermined post-processing on the sheet P conveyed from the relay conveying device 10.

Overview of Image Forming Apparatus 20

First, a description is given of the overview of the image forming apparatus 20. The image forming apparatus 20 includes an image forming device 201, a sheet container 202 including sheet feeding trays, a sheet feeding device 203 as a sheet feeder, a sheet conveying device 204 as a sheet conveyor, a sheet reverse passage changer 206 as a conveyance passage switching device, a document reading device 208 as a document reader, a sheet reverse passage 209 through which a sheet is conveyed for forming images on both sides of the sheet, and a controller 200 as a control device or circuitry.

The controller 200 controls the overall operations of the configuration included in the image forming apparatus 20. The controller 200 has a communication function of transmitting and receiving information to and from a controller 100 as a control device or circuitry included in the relay conveying device 10, and controls the operations of the image forming device 201 and the sheet conveying device 204 in conjunction with the operation of the relay conveying device 10.

The image forming device 201 as an image forming device includes liquid discharge heads having respective discharging ports (nozzles). The liquid discharge heads discharge respective liquid inks of four colors, for example, of Y (yellow), M (magenta), C (cyan), and K (black). The liquid discharge head is separately provided to discharge liquid ink of each color. The liquid ink is supplied to each liquid discharge head included in the image forming device 201 by an ink supply pump that is coupled with each ink cartridge. Therefore, the liquid ink is supplied to each liquid discharge head by the ink supply pump from an ink cartridge containing the liquid ink of each color. Note that the ink cartridge of each color is detachably attached to a cartridge charger included in the image forming apparatus 20.

The sheet container 202 includes a plurality of sheet feed trays to load and contain sheets P as sheet media. The sheet P refers to any medium, such as paper (paper), an OHP sheet, yarn, fiber, fabric, leather, metal, or plastic, on which an image is formed by attaching ink and which can be conveyed while being curved.

The sheet feeding device 203 includes a sheet pickup roller, a sheet separation roller, and a sheet reverse roller. The pickup roller picks up some of the sheets P contained in the sheet container 202. The separation roller and the sheet reverse roller separate and feed the picked-up sheets P one by one.

The sheet conveying device 204 includes the plurality of pairs of sheet conveying rollers disposed at different positions along the sheet conveyance passage of the sheet P. Each pair of sheet conveying rollers includes a sheet conveying roller and a spur wheel. Each pair of sheet conveying rollers is rotated by a conveyance drive device to convey the sheet P in the predetermined direction at the predetermined conveying speed. Note that one of the pair of sheet conveying rollers is not limited to a spur wheel but may be a rotary body that has the substantially same size of the contact area to contact the sheet P as the contact area of the spur wheel and that partially contacts the sheet P. For example, the rotary body may be an abrasive roller having an abrasive surface.

The sheet reverse passage changer 206 includes a switching claw that guides the sheet P to the sheet reverse passage 209. The sheet reverse passage 209 reverses the image forming surface of the sheet P and conveys the sheet P to the image forming device 201. When forming images on both sides (i.e., the front and back faces) of the sheet P, the sheet P having an image formed by the image forming device 201 on the first side (e.g., the front face) is temporarily conveyed downstream in a conveyance direction until the trailing edge of the sheet P passes the sheet reverse passage changer 206. Then, after the sheet reverse passage changer 206 changes the sheet conveyance passage, the sheet P is conveyed in reverse, in other words, upstream in the conveyance direction, so that the sheet P is conveyed to another sheet conveyance passage that guides the sheet P form the sheet reverse passage 209 to the image forming device 201. Thereafter, the image forming device 201 forms an image on the second face of the reversed sheet P that faces the image forming device 201. The second face of the sheet P is the opposite face of the first face (e.g., the back face).

Overview of Relay Conveying Device 10

As illustrated in FIG. 1, the relay conveying device 10 is installed in the body of the inkjet printer 1, and includes a mechanism that selectively uses a plurality of conveyance passages to convey a sheet P as a conveyance object to the post-processing apparatus 30.

From the sheet conveying device 204 disposed closer to an ejection port of the image forming apparatus 20, one conveyance passage is selected from among the plurality of conveyance passages arranged side by side in the vertical direction via a sheet carry-in unit 140 included in the relay conveying device 10, and is used as a conveyance passage of the sheet P. A first selective conveyance roller pair 111, a second selective conveyance roller pair 112, and a third selective conveyance roller pair 113 are disposed as conveyors on the plurality of conveyance passages. The first selective conveyance roller pair 111, the second selective conveyance roller pair 112, and the third selective conveyance roller pair 113 merge into a merged conveyance passage on the downstream side in the conveyance direction. A sheet ejection roller pair 151 is disposed on the merged conveyance passage.

Configuration of Relay Conveying Device 10

Figure 2:
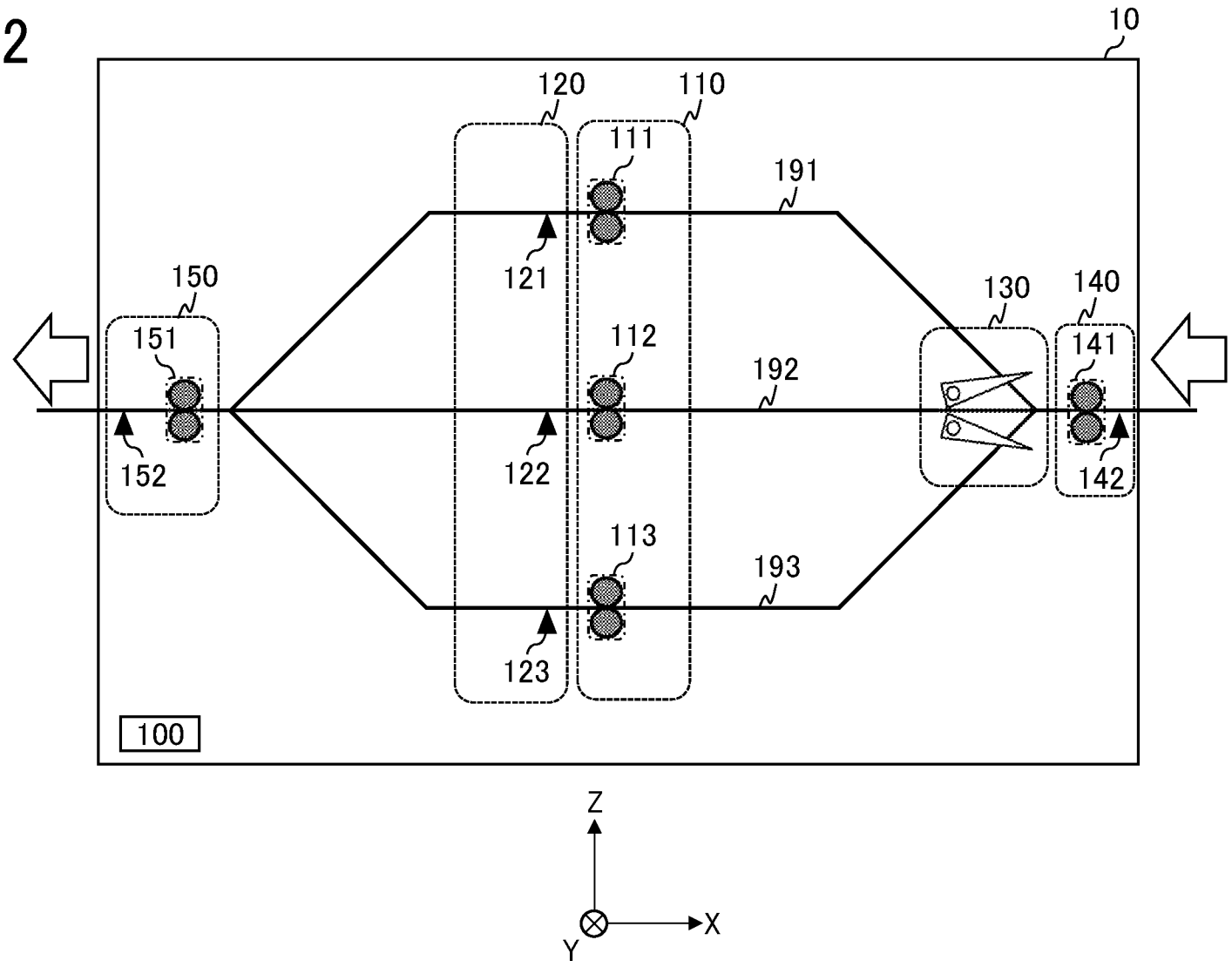
FIG. 2 is a schematic view of a relay conveying device as a conveying device according to an embodiment of the present disclosure.

Next, the configuration of the relay conveying device 10 is described with reference to FIG. 2. The relay conveying device 10 includes a selective conveyance unit 110 as a conveyor, a sheet leading-edge detection unit 120 as a conveyance availability detector, a conveyance passage switching unit 130 as a conveyance direction switching device, a sheet carry-in unit 140 as an entrance conveyor, and a sheet ejection unit 150 as an exit conveyor.

Selective Conveyance Unit 110

The selective conveyance unit 110 performs conveyance or conveyance stop of the sheet P in a conveyance passage selected from the plurality of conveyance passages. The selective conveyance unit 110 includes a first selective conveyance roller pair 111 that conveys or stops conveying the sheet Pin an upper conveyance passage 191 as a first conveyance passage, a second selective conveyance roller pair 112 that conveys or stops conveying the sheet P in a straight conveyance passage 192 as a second conveyance passage, and a third selective conveyance roller pair 113 that conveys or stops conveying the sheet P in a lower conveyance passage 193 as a third conveyance passage. The selective conveyance unit 110 performs conveyance for conveying the conveyed sheet P in a direction of ejection, and performs conveyance stop for temporarily holding the sheet P in the selective conveyance unit 110. Control in the selective conveyance unit 110 is performed by the controller 100.

The sheet leading-edge detection unit 120 includes a first sheet leading-edge detection sensor 121 corresponding to the first selective conveyance roller pair 111, a second sheet leading-edge detection sensor 122 corresponding to the second selective conveyance roller pair 112, and a third sheet leading-edge detection sensor 123 corresponding to the third selective conveyance roller pair 113. The sheet leading-edge detection unit 120 detects the leading edge of the sheet P conveyed by a predetermined conveyance roller pair of the selective conveyance unit 110 corresponding to a predetermined conveyance passage selected and notifies the controller 100 of the detected leading edge. The controller 100 stops the conveyance by the predetermined conveyance roller pair of the selective conveyance unit 110 and causes the conveyance roller pair to stay in the conveyance passage after a predetermined time elapses from the notification of the leading edge or after the predetermined conveyance roller pair of the selective conveyance unit 110 is rotationally driven by a predetermined amount.

Figure 3A:
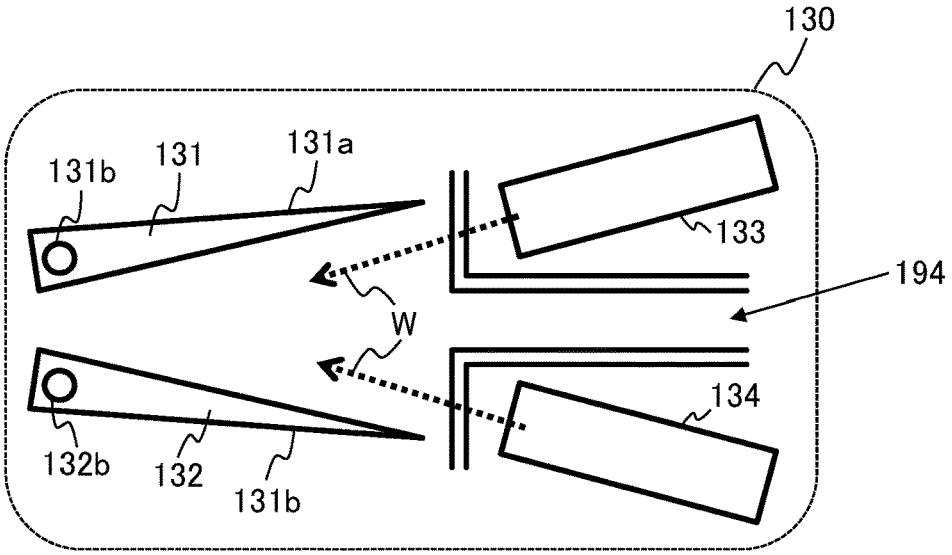
FIGS. 3A, 3B, and 3C are illustrations of a conveyance passage switching unit included in the relay conveying device according to an embodiment of the present disclosure.
Figure 3B:
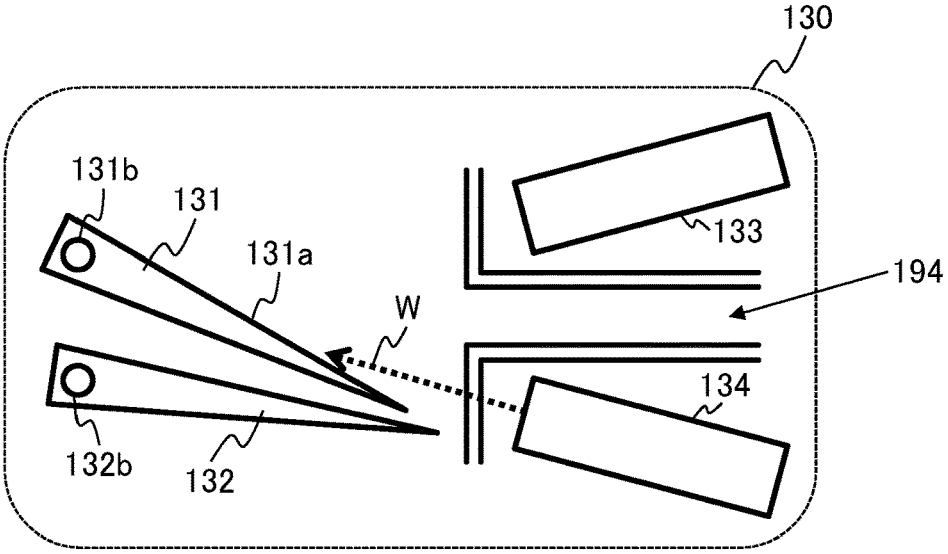
Figure 3C:
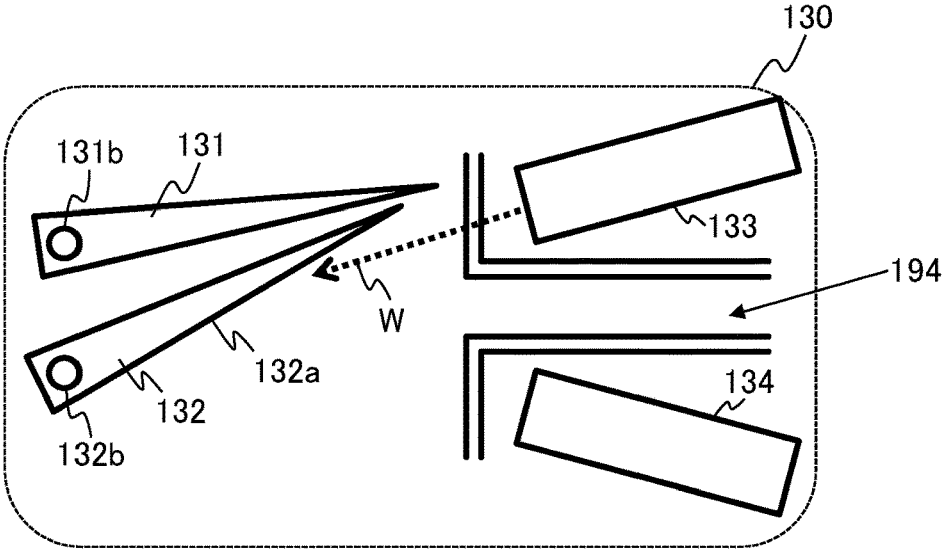

The conveyance passage switching unit 130 includes a switching member and a blower. The switching member serves as a conveyance passage guide that switches the conveyance direction of the sheet P. The blower operates in accordance with the switching operation state of the switching member. FIGS. 3A, 3B, and 3C are partially enlarged views of the conveyance passage switching unit 130. As illustrated in FIGS. 3A, 3B, and 3C, the conveyance passage switching unit 130 includes a first switching claw 131 and a second switching claw 132 as switching members, and a first heater 133 and a second heater 134 as blowers (hot air fans).

The first switching claw 131 includes a first contact portion 131*a* and a first shaft 131*b*. The first contact portion 131*a* is rotatably held around the first shaft 131*b* to guide a sheet P to the upper conveyance passage 191 or the straight conveyance passage 192 when the sheet P is conveyed from a carry-in passage 194. The second switching claw 132 includes a second contact portion 132*a* and a second shaft 132*b*. The second contact portion 132*a* is rotatably held around the second shaft 132*b* to guide a sheet P to the straight conveyance passage 192 or the lower conveyance passage 193 when the sheet P is conveyed from the carry-in passage 194. The first switching claw 131 and the second switching claw 132 are configured to be rotated by a motor whose driving is controlled by the controller 100.

The first heater 133 and the second heater 134 send out heated air (blow warm air) to promote drying of a sheet P and assist conveyance. FIG. 3A illustrates a state in which a sheet P carried in from the carry-in passage 194 by the sheet carry-in unit 140 is conveyed using the straight conveyance passage 192 as the second conveyance passage. At this time, the first switching claw 131 and the second switching claw 132 are maintained or moved so as to be positioned at initial positions separated from each other with respect to the carry-in passage 194, and form a conveyance passage to the straight conveyance passage 192 corresponding to an extension line of the carry-in passage 194. At this time, both the first heater 133 and the second heater 134 blow air. The air blown from the first heater 133 and the second heater 134 is directed in the conveyance direction of the sheet P to the straight conveyance passage 192, and is blown between the first contact portion 131*a* and the sheet P and between the second contact portion 132*a* and the sheet P. Therefore, the sheet P is easily moved in the conveyance direction by the air blown by the first heater 133 and the second heater 134.

FIG. 3B illustrates a state in which the sheet P carried in from the carry-in passage 194 is conveyed using the upper conveyance passage 191 as the first conveyance passage. At this time, the first switching claw 131 is rotated clockwise from the initial position, and the second switching claw 132 remains at the initial position. Accordingly, a conveyance passage from the carry-in passage 194 to the upper conveyance passage 191 is formed. At this time, the first heater 133 stops blowing air, and only the second heater 134 blows air. The air blown from the second heater 134 hits the first contact portion 131*a* of the first switching claw 131, is directed in the conveyance direction of the sheet P to the upper conveyance passage 191, and is blown between the first contact portion 131*a* and the sheet P. Thus, the sheet P is easily moved in the conveyance direction by the air blown by the second heater 134.

FIG. 3C illustrates a state in which the sheet P carried in from the carry-in passage 194 is conveyed using the lower conveyance passage 193 as the third conveyance passage. At this time, the first switching claw 131 remains at the initial position, and the second switching claw 132 is rotated counterclockwise from the initial position. Accordingly, a conveyance passage from the carry-in passage 194 to the lower conveyance passage 193 is formed. At this time, the second heater 134 stops blowing air, and only the first heater 133 blows air. The air blown from the first heater 133 hits the second contact portion 132*a* of the second switching claw 132, is directed in the conveyance direction of the sheet P to the lower conveyance passage 193, and is blown between the second contact portion 132*a* and the sheet P. Thus, the sheet P is easily moved in the conveyance direction by the air blown by the first heater 133.

That is, the air blowing direction is controlled by the controller 100 so that, in accordance with a guide direction in which the sheet P as a conveyance object is guided by the switching member as the conveyance passage guide, the air blown from the first heater 133 and the second heater 134, which are the blowers, moves in a direction along the guide direction.

Referring back to FIG. 2, the sheet carry-in unit 140 includes sheet carry-in roller pair 141 and a sheet carry-in sensor 142. The sheet carry-in roller pair 141 serves as an entrance conveyor that is a conveyor to convey the sheet P to the selective conveyance passage. The sheet carry-in sensor 142 serves as a carry-in detector that is a conveyance detector to detect entry of the sheet P into the carry-in passage 194. The detection of the sheet P by the sheet carry-in sensor 142 triggers the operation of the sheet carry-in roller pair 141 and the operation of the conveyance passage switching unit 130.

The sheet ejection unit 150 ejects the sheet P conveyed from each conveyance roller pair of the selective conveyance unit 110 from the relay conveying device 10. The sheet ejection unit 150 includes a sheet ejection roller pair 151 and a sheet ejection sensor 152. The sheet ejection roller pair 151 serve as an exit conveyor that is a conveyor. The sheet ejection sensor 152 serves as an ejection detector that is a detector. The sheet ejection roller pair 151 is rotated to discharge the sheet P to the post-processing apparatus 30. The sheet ejection sensor 152 detects that the sheet P has been ejected from the conveyance passage by detecting the trailing edge of the sheet P in the conveyance direction. The detection result is notified to the controller 100.

Note that the first selective conveyance roller pair 111, the second selective conveyance roller pair 112, the third selective conveyance roller pair 113, the sheet carry-in roller pair 141, and the sheet ejection roller pair 151 are rotated by a motor as a driving unit whose driving is controlled by the controller 100. The first contact portion 131*a* and the second contact portion 132*a* are maintained at the initial positions by the biasing force of a spring as a biasing member. When turned on (operated) by an actuator such as a solenoid as a driving device whose driving is controlled by the controller 100, each of the first contact portion 131*a* and the second contact portion 132*a* is rotated in a first direction from the initial position. When turned off (not operated), each of the first contact portion 131*a* and the second contact portion 132*a* is rotated in a second direction opposite to the first direction by the biasing force of the spring and returned to the initial position.

Hardware Configuration of Controller 100

Figure 4:
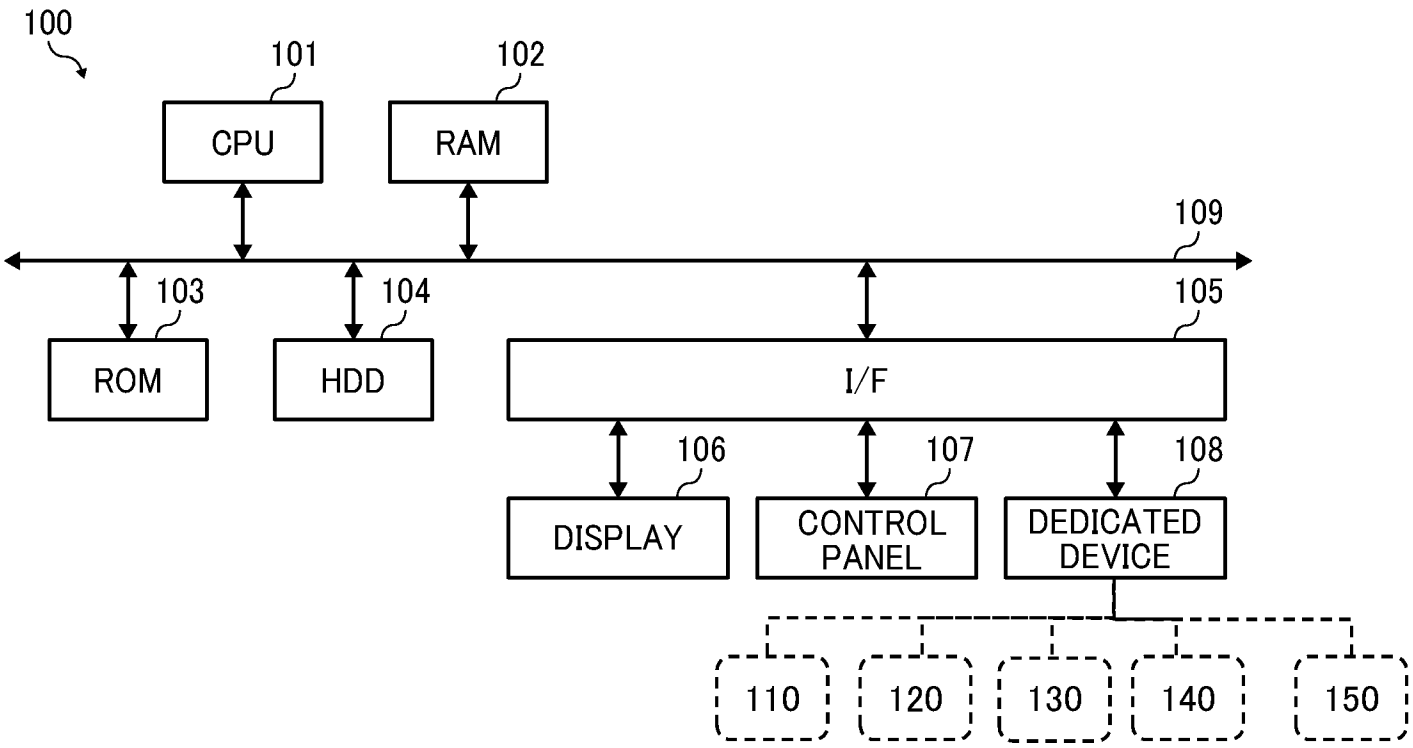
FIG. 4 is a hardware configuration diagram illustrating a configuration of a controller of the relay conveying device, according to an embodiment of the present disclosure.

Next, the controller 100 that controls the operation of the relay conveying device 10 is described. FIG. 4 is a diagram illustrating a hardware configuration of the controller 100 according to an embodiment of the present disclosure. The hardware configuration illustrated in FIG. 4 includes a similar configuration to the hardware configuration of a general information processing device. In the controller 100 according to the present embodiment, a central processing unit (CPU) 101, a random access memory (RAM) 102 as a storage device, a read only memory (ROM) 103 as a storage device, a hard disk drive (HDD) 104 as a storage device, and an interface (I/F) 105 as an interface are connected via a bus 109 as a communication member. A display 106, a control panel 107, and a dedicated device 108 are connected to the I/F 105.

The CPU 101 is an arithmetic unit that controls the operation of the entire relay conveying device 10. The RAM 102 is a volatile storage medium that allows data to be read and written at high speed. The CPU 101 uses the RAM 102 as a work area for data processing. The ROM 103 is a read-only non-volatile storage medium that stores programs such as firmware. The HDD 104 is a non-volatile storage medium that allows data to be read and written and has a relatively large storage capacity. The HDD 104 stores, e.g., an operating system (OS), various control programs, and application programs. The various control programs include a medium conveyance control program and a post-processing control program.

The I/F 105 connects various types of hardware or networks to the bus 109, and controls the operations performed between the bus 199 and the various hardware and networks. The display 106 is a visual user interface through which a user checks the status of the relay conveying device 10 and the set operation mode. The display 106 includes a display device such as a liquid crystal display (LCD). The control panel 107 as an operation unit is a user interface for the user to input the setting of the operation mode of the relay conveying device 10.

The dedicated device 108 is hardware to achieve the function of performing a dedicated operation in the relay conveying device 10, and is, for example, each hardware configuration such as the selective conveyance unit 110, the sheet leading-edge detection unit 120, the conveyance passage switching unit 130, the sheet carry-in unit 140, and the sheet ejection unit 150.

In the controller 100, the CPU 101 reads out programs stored in the ROM 103 or the HDD 104 to the RAM 102 and executed the programs. Thus, the controller 100 constitutes a software controller to achieve the predetermined function using each hardware configuration included in the dedicated device 108.

Figure 5:
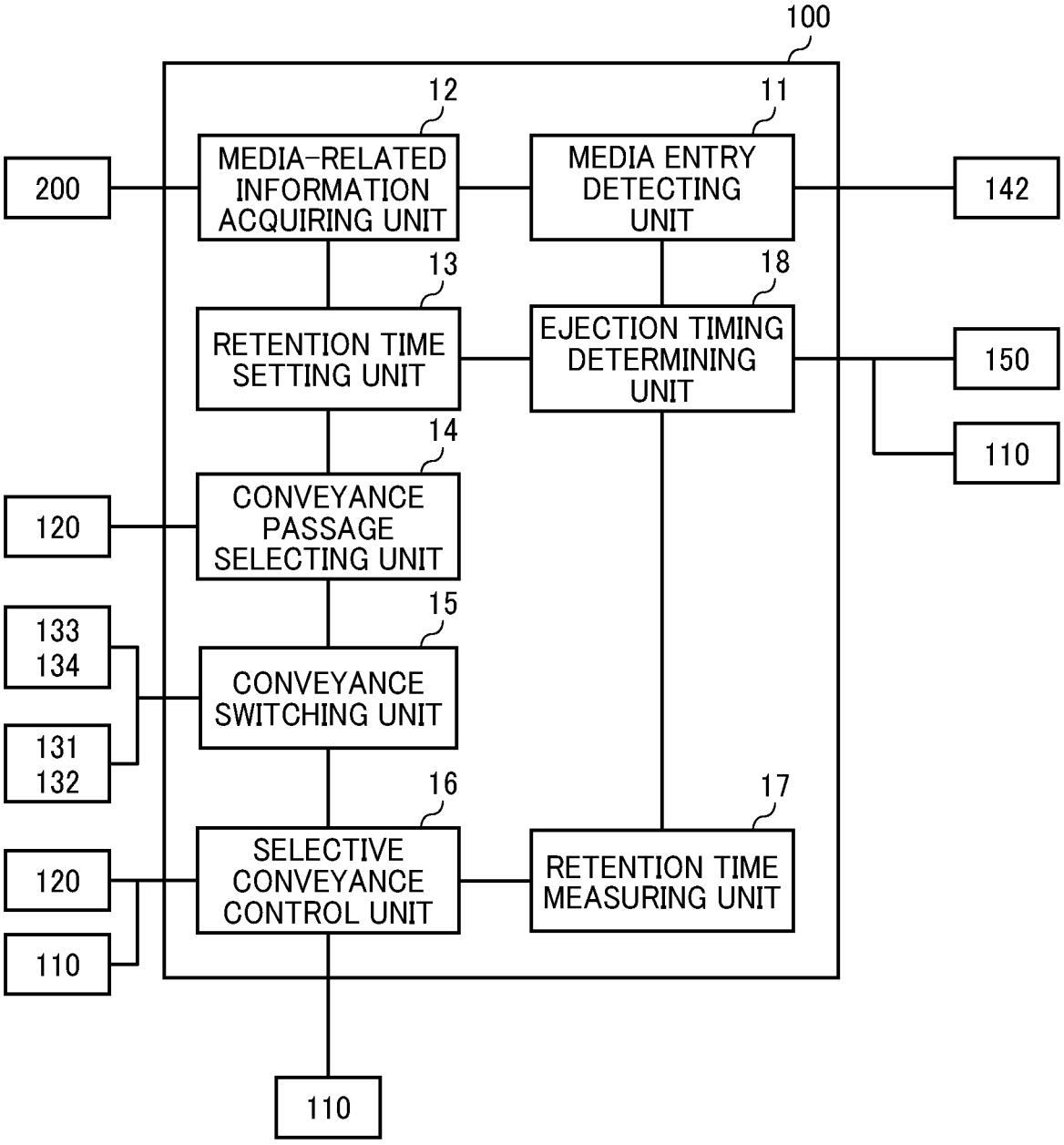
FIG. 5 is a functional block diagram illustrating a functional configuration of the controller of the relay conveying device, according to an embodiment of the present disclosure.

Functional Block of Controller 100 Next, an example of functional blocks realized by the controller 100 is described with reference to FIG. 5. As illustrated in FIG. 5, the controller 100 includes a media entry detecting unit 11, a media-related information acquiring unit 12, a retention time setting unit 13, a conveyance passage selecting unit 14, a conveyance switching unit 15, a selective conveyance control unit 16, a retention time measuring unit 17, and an ejection timing determining unit 18. The media entry detecting unit 11 is electrically connected to the sheet carry-in sensor 142. The media-related information acquiring unit 12 is electrically connected to the controller 200 of the image forming apparatus 20. The retention time setting unit 13 sets a set retention time required for drying a conveyance object calculated based on the content of the image formation process for each conveyance object. The conveyance passage selecting unit 14 is electrically connected to the leading-edge detection sensors of sheet leading-edge detection unit 120. The conveyance switching unit 15 is electrically connected to the first switching claw 131, the second switching claw 132, the first heater 133, and the second heater 134. The retention time measuring unit 17 is electrically connected to the selective conveyance unit 110 and the sheet leading-edge detection unit 120. The ejection timing determining unit 18 is electrically connected to the selective conveyance unit 110 and the sheet ejection unit 150 to determine whether the retention time of the conveyance object conveyed to each conveyance passage of the upper conveyance passage 191, the straight conveyance passage 192, and the lower conveyance passage 193 exceeds the set retention time.

The media entry detecting unit 11 monitors the sheet carry-in sensor 142 and detects that the sheet P is carried into the carry-in passage 194 when the sheet carry-in sensor 142 is turned on. The detection result is notified to the media-related information acquiring unit 12 and the ejection timing determining unit 18.

The media-related information acquiring unit 12 requests the controller 200 of the image forming apparatus 20, based on the notification from the media entry detecting unit 11, to acquire "media-related information" related to the sheet P carried in from the image forming apparatus 20. The media-related information is information necessary for calculating and setting the time required for drying the conveyed sheet P. Examples of the media-related information include, but not limited to, information for identifying whether image formation on the sheet P is "single-sided" or "double-sided", information relating to the printing rate on the sheet P, and information indicating the amount of liquid ink adhering to the sheet P (based on image data). The acquired media-related information is notified to the retention time setting unit 13.

The retention time setting unit 13 as a drying time setting unit and a retention time setting unit calculates a retention time necessary for drying based on the notified media-related information and stores the retention time in association with the sheet P. The retention time setting unit 13 notifies the ejection timing determining unit 18 and the conveyance passage selecting unit 14 of the calculated retention time and information for identifying the sheet P.

The conveyance passage selecting unit 14 selects the conveyance passage of the sheet P based on the retention time calculated by the retention time setting unit 13 and the use state (empty state) of the conveyance passage acquired by the sensors included in the sheet leading-edge detection unit 120. The selection result is notified to the conveyance switching unit 15.

The conveyance switching unit 15 causes the first switching claw 131 and the second switching claw 132 constituting the conveyance passage switching unit 130 to perform the switching operation based on the selection result from the conveyance passage selecting unit 14. The conveyance switching unit 15 causes the first heater 133 or the second heater 134 or both to perform the blowing operation. At the same time as the above-described operations, the sheet carry-in roller pair 141 is driven to move the sheet Pin the conveyance direction. Accordingly, the sheet P is selectively conveyed toward any one of the upper conveyance passage 191, the straight conveyance passage 192, and the lower conveyance passage 193.

The selective conveyance control unit 16 as a selective conveyance control unit that is a control unit controls driving of the conveyance roller pair disposed in the conveyance passage selected. Accordingly, the sheet P is conveyed to any one of the conveyance passages, and is detected by the sheet leading-edge detection unit 120 as a conveyance detector disposed on the conveyance passage. After an elapse of a predetermined time from the detection by the sheet leading-edge detection unit 120 or after the end of a predetermined conveyance driving, the operation of a drive motor for driving the selective conveyance unit 110 is stopped. The sheet leading-edge detection unit 120 notifies the retention time measuring unit 17 of the detection result.

The retention time measuring unit 17 as an elapsed time measuring unit measures the retention time from the start of retention of each sheet P retained in the conveyance passage by the operation of the selective conveyance control unit 16, and notifies the ejection timing determining unit 18 of the retention time.

The ejection timing determining unit 18, which is an ejection determining unit and serves as an ejection unit, determines whether the retention time measured by the retention time measuring unit 17 exceeds the set retention time set by the retention time setting unit 13. If the retention time is less than the set retention time, the ejection timing determining unit 18 determines that it is not the timing to convey the sheet P. When the retention time is equal to or longer than the set retention time, the ejection timing determining unit 18 causes the selective conveyance unit 110 and the sheet ejection unit 150 to be operated to eject the sheet P whose retention time has passed the set retention time in the order of pages.

Conveyance Control Flow

Figure 6:
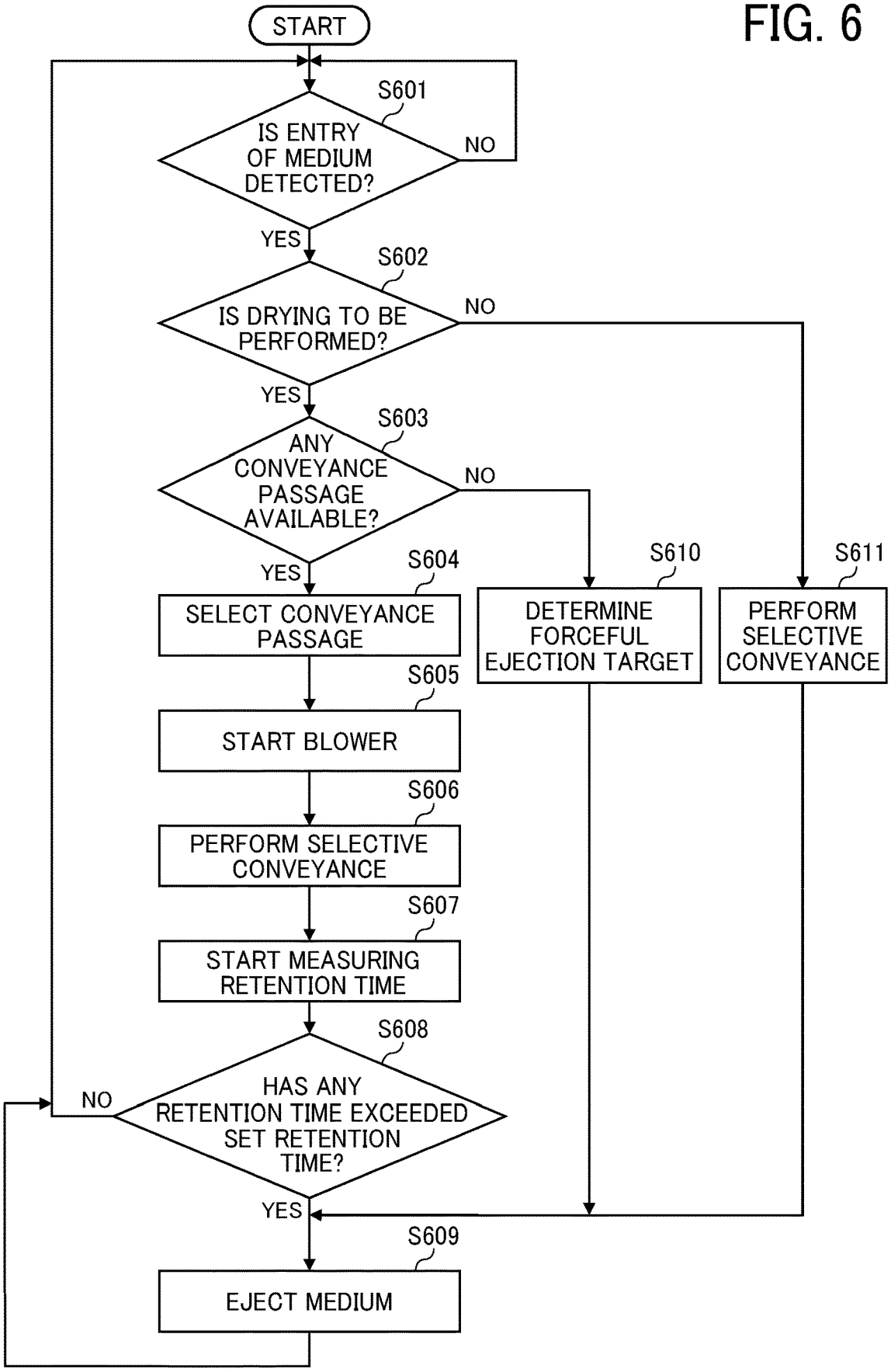
FIG. 6 is a flowchart illustrating a flow of conveyance control by the relay conveying device, according to an embodiment of the present disclosure.

Next, a flow of a conveyance control process executed by the controller 100 of the relay conveying device 10 is described with reference to a flowchart of FIG. 6. First, when the sheet carry-in sensor 142 in the sheet carry-in unit 140 detects the carry-in of the sheet P (YES in step S601), the controller 100 acquires the media-related information related to the carried-in sheet P and determines whether the sheet P is a target to be dried (step S602).

The determination in step S601 is performed based on the media-related information. For example, the controller 100 determines whether the sheet P is a target to be dried after the image formation process. If the sheet P is not the target to be dried, the drying is not performed (NO in step S602). In addition, the controller 100 determines whether the drying will be completed during the conveyance of the drying target, based on the printing rate or the like, and determines whether it is necessary to cause the drying target to stay in the relay conveying device 10 for drying. If it is not necessary to cause the drying target to stay in the relay conveying device 10, the drying is not performed (NO in step S602).

In step S602, when the controller 100 determines not to perform the drying (NO in step S602), the controller 100 causes the sheet P to be ejected using an available conveyance passage without being retained. However, in a case in which there is a retained sheet P that is already retained, the controller 100 causes the sheet P to stay in an empty conveyance passage and be conveyed so as to be ejected after the retained sheet P retained is ejected. If there is no vacant conveyance passage, the sheet P having the longest elapsed time among retained sheets P is forcibly ejected to form an empty conveyance passage (step S609 and step S611).

In step S602, when the controller 100 determines that drying is to be performed (drying is necessary) (YES in step S602), the controller 100 refers to the detection state of the sheet leading-edge detection unit 120 and determines whether there is an empty space in the conveyance passage (step S603). If there is no empty space in the conveyance passage (NO in step S603), the sheet P having the longest elapsed time (the earliest page order) among the retained sheets P is forcibly ejected to form an empty space in the conveyance passage (step S610).

In step S603, if there are one or more empty conveyance passages (YES in step S603), the conveyance passage selecting unit 14 selects one of the empty conveyance passages (step S604). When a plurality of conveyance passages are empty, the order of priority of selection may be defined in advance, and selection may be performed according to the order of priority. For example, the straight conveyance passage 192, the upper conveyance passage 191, and the lower conveyance passage may be set as the first priority passage, the second priority passage, and the third priority passage, respectively.

Subsequently, in accordance with the selected conveyance passage, the controller 100 causes one or both of the first heater 133 and the second heater 134 as the blowers to start blowing air (step S605).

Subsequently, the sheet P is conveyed to the selected conveyance passage and retained in the conveyance passage based on the detection result by the corresponding sensor of the sheet leading-edge detection unit 120 (step S606), and measurement of the retention time is started (step S607).

After the step S607, the controller 100 determines whether the retention time exceeds the set retention time (step S608), and the process is returned to the step S601 while the retention time is less than the set retention time. When the retention time is equal to or longer than the set retention time and the sheet P has the earliest page order (YES in step S608), the target sheet P is ejected (step S609).

As described above, according to the relay conveying device 10, the retention (drying) time of the sheet P can be maintained as long as possible according to the degree of necessity of drying (in other words, the necessity of drying or the length of drying time) of the sheet P. Such a configuration can effectively dry the sheet P being conveyed.

In addition, since effective heating (air blowing) is performed according to the selected conveyance passage by the driers (heaters) whose number is smaller than the number of selectable conveyance passages, a configuration advantageous in downsizing can be achieved even in a configuration including a plurality of conveyance passages. In addition, the number of driers can be reduced, which is advantageous in terms of manufacturing cost.

Functional Block of Controller 200

Next, an example of functional blocks implemented by the controller 200 included in the image forming apparatus 20 is described with reference to FIG. 7. Since the hardware configuration of the controller 200 is the same as the hardware configuration of the controller 100, redundant descriptions thereof are omitted.

Figure 7:
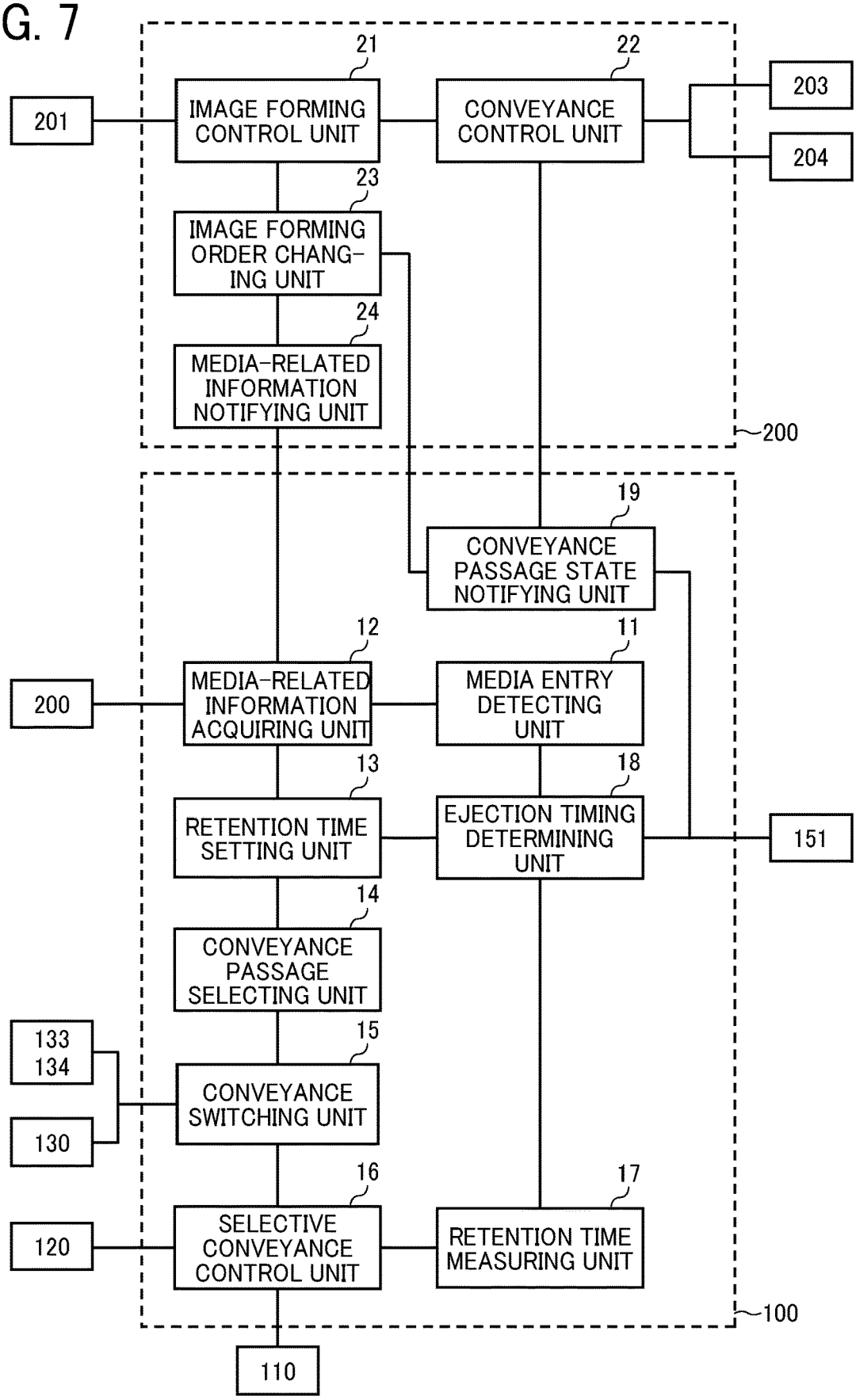
FIG. 7 is a functional block diagram illustrating a functional configuration of a controller of the inkjet printer, according to an embodiment of the present disclosure.

As illustrated in FIG. 7, the controller 200 includes an image forming control unit 21, a conveyance control unit 22, an image forming order changing unit 23, and a media-related information notifying unit 24. As the functional blocks for cooperating with the controller 200, the controller 100 further includes a conveyance passage state notifying unit 19 in addition to the units already described.

The image forming control unit 21 is electrically connected to the image forming device 201 and controls the image formation process in the image forming device 201.

The conveyance control unit 22 is electrically connected to the sheet feeding device 203 and the sheet conveying device 204, and controls operations of the sheet feeding device 203 and the sheet conveying device 204 to perform control of conveying the sheet P to the image forming device 201 and control of conveying the sheet P after image formation to the relay conveying device 10.

The image forming order changing unit 23 controls the order of image formation processes performed by the image forming control unit 21 based on the "media-related information" (for example, information related to the printing rate and the set retention time necessary for drying) of each conveyance object of one set (one job or one part) of conveyance objects including a plurality of conveyance objects. The conveyance passage state information is, for example, information such as the number of conveyance passages of the relay conveying device 10, the length of each conveyance passage, and the drying capability of the drier. Further, the change of the image forming order means that the order of image formation processes for the respective sheets P is changed in one set of image formation processes (or a job). For example, when image formation processes for a total of five pages is performed, normally, the image formation processes are performed in order from the first page. Alternatively, the second page and the fourth page may be replaced with the third page and fifth page, respectively, to perform the image formation processes, or the image formation processes may be performed from the third page before the first page.

However, the image forming order changing unit 23 does not execute the image formation processes in a good order as described above, but preferentially executes the image formation processes resulting in an image formation result requiring a longer retention time. In other words, the image forming control unit 21 controls the image formation processes so that an image formation process with a high printing rate is executed before an image formation process with a low printing rate.

In addition, the image forming order changing unit 23 includes information indicating the changed order of the image formation processes in the media-related information and transfers the media-related information to the media-related information notifying unit 24.

The media-related information notifying unit 24 notifies the relay conveying device 10 of the media-related information including the printing rate of each sheet included in one job and the original order (page number) of the sheets.

Image Formation Control Flow

Figure 8:
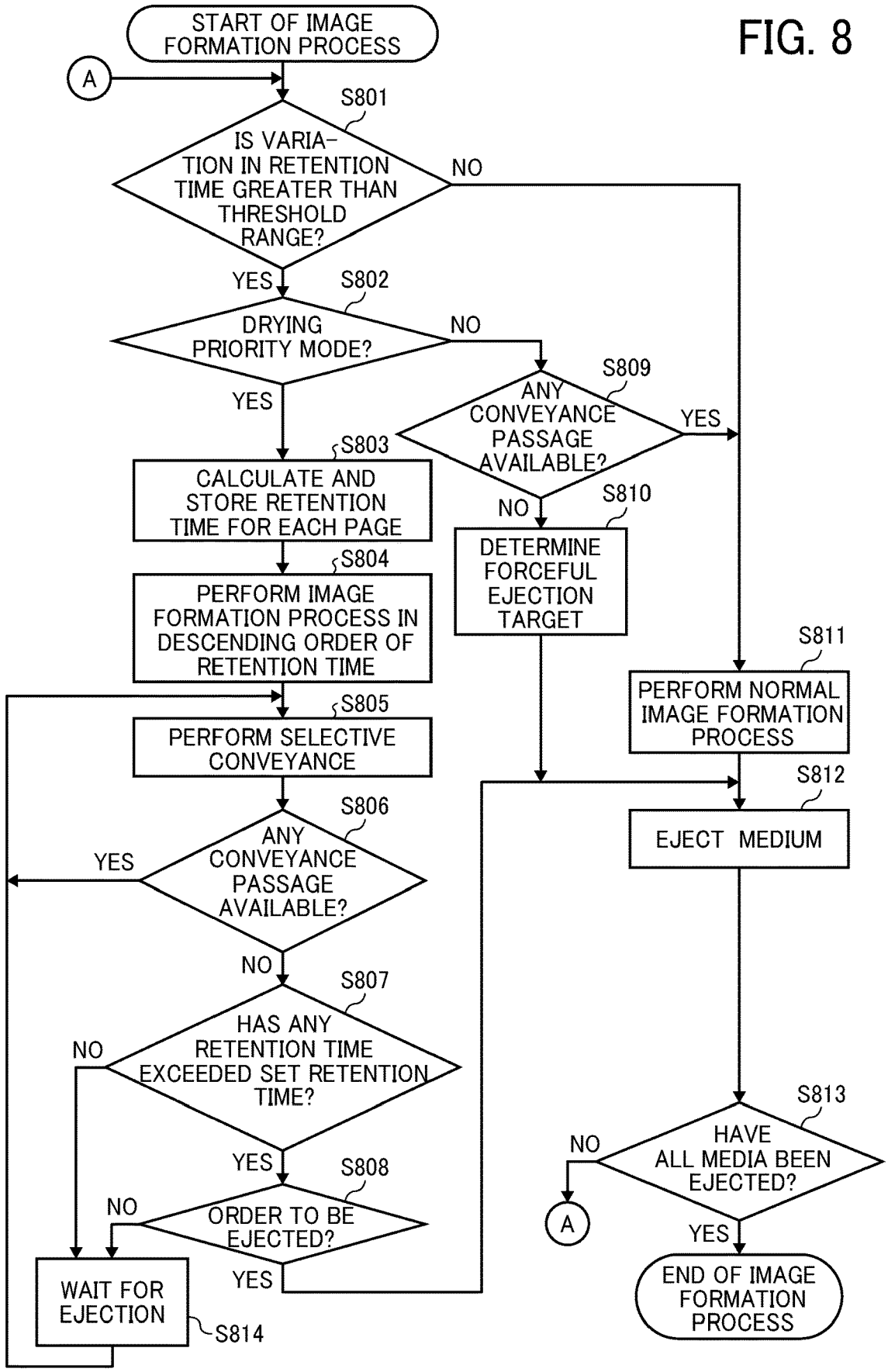
FIG. 8 is a flowchart illustrating a flow of control performed by the inkjet printer, according to an embodiment of the present disclosure.

Next, the flow of an image formation control process executed by the controller 200 of the image forming apparatus 20 and the controller 100 of the relay conveying device 10 is described with reference to the flowchart of FIG. 8. The present embodiment is an example of a case in which the sheet P on which an image has been formed is conveyed to the post-processing apparatus 30 when a set of image formation processes (or a job) is executed in the inkjet printer 1.

First, a set retention time required for drying an image formed on each sheet P by the image formation processes included in one job is calculated, and it is determined whether there is a variation exceeding a predetermined range in the set retention time of each sheet P (whether the set retention time of the next page is longer than the set retention time of the previous page by a predetermined time) (step S801). If there is no exceeding variation (NO in step S801), the image formation processes are performed without changing the order of image formation processes as usual (step S811). The sheets are ejected to the post-processing apparatus 30 in the order in which images have been formed on the sheets (step S812). When all the sheets P have been ejected (YES in step S813), the process ends. If all the sheets P have not been conveyed, the process returns to the beginning (NO in step S813).

If there is a variation exceeding the predetermined range in step S801 (YES in step S801), in step S802, it is determined whether the operation mode of the inkjet printer 1 is a "drying priority mode" or a "productivity priority mode". The operation mode is set in advance and stored in a storage area included in the controller 200.

When the operation mode is the "productivity priority mode" (NO in step S802), the controller 200 determines whether there is an empty space in the conveyance passage based on the conveyance passage state information from the controller 100 (step S809). Here, if there is an empty space (YES in step S809), a normal image formation process is performed and sheets P are ejected according to the image forming order (step S811 and step S812). If there is no empty space in the S809 (NO in step S809), a sheet P having the earliest page order among sheets P retained in the conveyance passage is set as a target to be forcibly ejected (step S810) and is ejected (step S812).

If the operation mode is the "drying priority mode" (YES in step S802), the retention time for each page is calculated and stored in the image formation process included in the job (step S803). Subsequently, the image forming control unit 21 is controlled so as to execute the image formation process on a page having a longer set retention time before a page having a shorter set retention time by reflecting the drying efficiency, that is, so as to execute the image formation process including the change of the order of pages on which images are formed (step S804).

Subsequently, similarly with the step S606 described above, sheets P are conveyed in turn to the selected conveyance passage (step S805). At this time, if there is an empty space in the conveyance passages (YES in step S806), the process is looped until the conveyance passages are full. If there is no empty space in the conveyance passages (NO in step S806), it is determined whether there is a sheet that can be ejected with the retention time exceeding the set retention time (step S807). If there is no sheet that can be ejected (NO in step S807), the sheet P is in a state of waiting for ejection, the sheet P is retained in the carry-in passage 194 and the image formation process is interrupted (step S814). At this time, as the conveyance passage state information, the controller 100 notifies the controller 200 of the image forming apparatus 20 of information indicating that the sheet P is waiting for an empty conveyance passage.

When there is a sheet P whose retention time exceeds the set retention time, it is determined whether the sheet P has an order to be ejected in relation to the order of the image formation process (step S808). The sheet P having the order to be ejected (in other words, having the earliest page order) (YES in step S808) is ejected to the post-processing apparatus 30 (step S812). That is, when there is a sheet P whose order of page number in the job has been changed in the image formation process, in S808, the order of page number is returned to the normal order (along the order of image formation processes before the change) and the sheet P is ejected according to the normal order. Accordingly, even if the order of the image formation processes is changed depending on the length of the set retention time, the order in which sheets are ejected to the post-processing apparatus 30 can be the same as the order in the normal image formation process.

In the productivity priority mode, the image forming processes are performed without changing the order of the image forming processes depending on the length of the set retention time. However, similarly to the drying priority mode, the order of the image forming processes may be changed according to the length of the set retention time to perform the image forming processes. When there is no empty space in the conveyance passages, the sheet P having the earliest page order may be forcibly ejected.

As described above, according to the inkjet printer 1 according to the present embodiment, even if the order of image formation processes on a plurality of sheets P is changed based on the "difficulty in drying", the sheets P can be ejected to the post-processing apparatus 30 in a correct order. Here, the "difficulty in drying" is determined using one or more of the amount of liquid ink used in an image formation process, the quality of an image to be formed, the thickness of the sheet P, the permeability of liquid, and the like. In other words, the inkjet printer 1 and the relay conveying device 10 according to the present embodiment includes a plurality of conveyance passages, thus allowing the productivity of image formation to be enhanced. The inkjet printer 1 and the relay conveying device 10 according to the present embodiment can also achieve both the productivity of image formation and the efficiency of drying of the sheet P used for post-processing. The enhancement of productivity and drying efficiency can be achieved with a compact configuration.

The present disclosure is not limited to specific embodiments described above, and numerous additional modifications and variations are possible in light of the teachings within the technical scope of the present disclosure. It is therefore to be understood that, the disclosure of the present specification may be practiced otherwise by those skilled in the art than as specifically described herein. Such modifications and alternatives are within the technical scope of the present disclosure.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure. The elements of the above-described embodiments can be modified without departing from the gist of the present disclosure, and can be appropriately determined according to the application form.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A conveying device, comprising:

a plurality of conveyance passages disposed in parallel to each other;

a plurality of conveyors, each one of which is disposed in corresponding one of the plurality of conveyance passages; a conveyance passage guide configured to guide a conveyance object to available one of the plurality of conveyance passages;

a conveyance sensor configured to detect the conveyance object guided by the conveyance passage guide; a conveyance availability detector configured to detect whether the plurality of conveyance passages are available for conveyance of the conveyance object; and circuitry configured to:

set a set retention time for which the conveyance object is to be retained in the available one of the plurality of conveyance passages;

control one of the plurality of conveyors to convey and stop conveying the conveyance object guided by the conveyance passage guide;

measure a retention time of the conveyance object conveyed in the available one of the plurality of conveyance passages; and cause the one of the plurality of conveyors to eject the conveyance object from the available one of the plurality of conveyance passages in a case in which the retention time of the conveyance object is longer than the set retention time.

2. The conveying device according to claim 1, further comprising a blower configured to blow air to the conveyance object guided by the conveyance passage guide, wherein the circuitry is configured to control the blower according to a guide direction of the conveyance passage guide.

3. The conveying device according to claim 2, further comprising a plurality of blowers including the blower, wherein each one of the blowers is configured to blow air in a direction along the guide direction of the conveyance passage guide.

4. The conveying device according to claim 1, wherein the circuitry is configured to cause one of the plurality of conveyors to eject a conveyance object having a longest retention time among conveyance objects retained in the plurality of conveyance passages, in a case in which the conveyance availability detector detects that none of the plurality of conveyance passages are available for conveyance of the conveyance object before the conveyance passage guide guides the conveyance object.

5. The conveying device according to claim 1, wherein the circuitry is configured to cause one of the plurality of conveyors to eject a conveyance object having a shortest retention time among conveyance objects retained in the plurality of conveyance passages, in a case in which the conveyance availability detector detects that none of the plurality of conveyance passages are available for conveyance of the conveyance object before the conveyance passage guide guides the conveyance object.

6. The conveying device according to claim 1, wherein the circuitry is configured to set the set retention time based on a drying time for drying the conveyance object.

7. The conveying device according to claim 6, wherein the circuitry is configured to determine the drying time based on an amount of liquid applied to the conveyance object.

8. An image forming apparatus, comprising:

a plurality of conveyance passages disposed in parallel to each other;

a plurality of conveyors, each one of which is disposed in corresponding one of the plurality of conveyance passages;

an image forming device configured to form images on one set of a plurality of conveyance objects;

a conveyance passage guide configured to guide each one of the plurality of conveyance objects to available one of the plurality of conveyance passages;

a conveyance availability detector configured to detect whether the plurality of conveyance passages are available for conveyance of the plurality of conveyance objects; and circuitry configured to:

set a set retention time for which each one of the plurality of conveyance objects is to be retained in the available one of the plurality of conveyance passages, according to content of an image forming process performed on each one of the plurality of conveyance objects;

control one of the plurality of conveyors to convey and stop conveying each one of the plurality of conveyance objects guided by the conveyance passage guide;

measure a retention time of each one of the plurality of conveyance objects conveyed in the available one of the plurality of conveyance passages;

change an order of image forming processes performed on the one set of the plurality of conveyance objects, according to the set retention time for each one of the plurality of conveyance objects;

cause the image forming device to perform the image forming processes on the plurality of conveyance objects in the order changed;

cause the plurality of conveyance objects to be conveyed to the plurality of conveyance passages; and cause the plurality of conveyors to eject the plurality of conveyance objects from the plurality of conveyance passages according to a pre-change order of the image forming processes.

9. The image forming apparatus according to claim 8, wherein the circuitry is configured to cause the image forming device to perform an image forming process on a following conveyance object following a preceding conveyance object before on the preceding conveyance object in a case in which a set retention time of the following conveyance object is longer than a set retention time of the preceding conveyance object by a predetermined time in image formation processes performed on the one set of the plurality of conveyance objects.

10. The image forming apparatus according to claim 8, wherein the circuitry is configured to cause one of the plurality of conveyors to eject a conveyance object having an earliest order of an image forming process, in a case in which the conveyance availability detector detects that none of the plurality of conveyance passages are available for conveyance of the plurality of conveyance objects before the conveyance passage guide guides each one of the plurality of conveyance objects.

* * * * *